US008845372B2

(12) United States Patent
Farmer

(10) Patent No.: US 8,845,372 B2
(45) Date of Patent: Sep. 30, 2014

(54) STANDING WATERCRAFT WITH TORSO-MOUNTED PADDLES

(76) Inventor: Jerome Connelly Farmer, Del Mar, CA (US)

( * ) Notice: Subject to any disclaimer, the term of this patent is extended or adjusted under 35 U.S.C. 154(b) by 316 days.

(21) Appl. No.: 13/426,786

(22) Filed: Mar. 22, 2012

(65) Prior Publication Data

US 2012/0244764 A1 Sep. 27, 2012

Related U.S. Application Data

(60) Provisional application No. 61/466,855, filed on Mar. 23, 2011, provisional application No. 61/501,254, filed on Jun. 27, 2011, provisional application No. 61/533,670, filed on Sep. 12, 2011.

(51) Int. Cl.

| | |
|---|---|
| ***B63H 16/04*** | (2006.01) |
| ***B63B 35/73*** | (2006.01) |
| ***B63H 5/07*** | (2006.01) |
| ***B63B 35/85*** | (2006.01) |
| *B63B 35/81* | (2006.01) |

(52) U.S. Cl.

CPC ..... *B63B 35/85* (2013.01); *B63H 16/04* (2013.01); *B63B 35/73* (2013.01); *B63H 5/07* (2013.01); *B63B 35/811* (2013.01)

USPC ..... 440/102

(58) Field of Classification Search

CPC ..... B63H 16/00; B63H 16/04

USPC ..... 440/101–104; 441/65, 76

See application file for complete search history.

(56) References Cited

U.S. PATENT DOCUMENTS

| | | | |
|---|---|---|---|
| 356,846 | A | 2/1887 | Martin |
| 791,852 | A | 6/1905 | Worcester |
| 1,006,118 | A | 10/1911 | Napier |
| 1,384,354 | A | 7/1921 | Sheldon |
| 1,475,031 | A | 11/1923 | Sheldon |
| 1,693,867 | A | 12/1928 | Reinwald |
| 1,719,059 | A | 7/1929 | Krupka et al. |
| 1,894,874 | A | 1/1933 | Kask |
| 2,153,939 | A | 4/1939 | Schaupp |
| 2,507,469 | A | 5/1950 | Hanson |
| 2,808,802 | A | 10/1957 | Graham |
| 2,873,713 | A | 2/1959 | Baastrup |
| 3,007,434 | A | 11/1961 | Laycox |
| 3,034,157 | A | 5/1962 | Abajian |
| 3,479,674 | A | 11/1969 | Beymer |
| 3,541,623 | A | 11/1970 | Duda |
| 3,566,427 | A | 3/1971 | Davis et al. |
| 3,609,782 | A | 10/1971 | Mabuchi |
| 3,835,494 | A | 9/1974 | Dougherty |
| 4,004,543 | A | 1/1977 | Cox |
| 4,043,291 | A | 8/1977 | Bearup et al. |
| 4,129,912 | A | 12/1978 | Robinson |
| 4,459,118 | A | 7/1984 | Schaumann |

(Continued)

*Primary Examiner* — Daniel V Venne

(74) *Attorney, Agent, or Firm* — Gifford, Krass, Sprinkle, Anderson & Citkowski, P.C.; Douglas L. Wathen

(57) ABSTRACT

An apparatus for floatation and propulsion of a user on a body of water includes a floatation device, a harness and a pair of paddles. The harness attaches to the user's torso and the paddles have upper ends that pivotally interconnect with the harness. The paddles have lower water engaging ends that may be moved in a paddling motion in a generally fore-aft direction relative to the harness.

22 Claims, 16 Drawing Sheets

(56) References Cited

U.S. PATENT DOCUMENTS

| | | | |
|---|---|---|---|
| 4,599,072 | A | 7/1986 | Pollini et al. |
| 4,618,329 | A | 10/1986 | Celez |
| 4,624,646 | A | 11/1986 | Strohmeier |
| 4,698,039 | A | 10/1987 | Watson |
| 4,804,345 | A | 2/1989 | Lee |
| 4,915,659 | A | 4/1990 | Sanders |
| 5,080,621 | A | 1/1992 | Nayes |
| 5,120,249 | A | 6/1992 | Fonda |
| 5,145,424 | A | 9/1992 | Han |
| 5,192,237 | A | 3/1993 | Pegoraro et al. |
| 5,236,381 | A | 8/1993 | Keogh |
| 5,387,143 | A | 2/1995 | Pitman |
| 5,421,759 | A | 6/1995 | Morin et al. |
| 5,462,466 | A | 10/1995 | Hull et al. |
| 5,593,334 | A | 1/1997 | Thayer |
| 6,264,519 | B1 * | 7/2001 | Brown ..... 441/55 |
| 7,311,573 | B1 * | 12/2007 | Dillenschneider ..... 440/101 |

* cited by examiner

STANDING WATERCRAFT WITH TORSO-MOUNTED PADDLES

CROSS-REFERENCE TO RELATED APPLICATIONS

This application claims priority to U.S. provisional patent application Ser. Nos. 61/466,855, filed Mar. 23, 2011, 61/501,254, filed Jun. 27, 2011, and 61/533,670, filed Sep. 12, 2011, each of which are incorporated herein in their entirety.

FIELD OF THE INVENTION

The present invention relates generally to an apparatus for floatation and propulsion of a user on a body of water.

BACKGROUND OF THE INVENTION

People have been attempting to move across the water in a standing position since at least 1817. This is usually done in one of two ways: by standing on a large singular board and paddling; or by standing in two pontoons and moving your feet back and forth. Both these methods have drawbacks.

Standing on a board and paddling with one paddle (i.e. standup paddleboarding) requires two hands for a single paddle without much leverage. Kayaking and canoeing is already less efficient than the rowing. Because the standing position provides less leverage than the sitting position of kayaking or canoeing, the paddling of standup paddleboarding is even less efficient.

The method of moving on the water by walking on two pontoons has the drawback of the problem of stability of the pontoons in reference to both the water and each other. Pontoons tend to tilt inward or outward, and to drift apart.

SUMMARY OF THE INVENTION

The present invention provides an apparatus for floatation and propulsion of a user on a body of water. The apparatus includes a floatation device for supporting a user on a body of water. The apparatus also includes a harness having a front face and a back face each extending between a first side and a second side. The harness is configured to receive a torso of the user such that an upper portion of the harness is adjacent the shoulders of the user.

A first paddle has an upper pivot end and a lower water engaging end with a mid-portion extending therebetween. The upper pivot end of the first paddle is pivotally interconnected with the harness on the first side of the harness such that the lower water engaging end may be moved in a paddling motion in a generally fore-aft direction relative to the harness. A second paddle has an upper pivot end and a lower water engaging end with a mid-portion extending therebetween. The upper pivot end of the second paddle is pivotally interconnected with the harness on the second side of the harness such that the lower water engaging end may be moved in a paddling motion in a generally fore-aft direction relative to the harness. In some embodiments, the pivotal interconnections between the upper pivot ends of the paddles and the harness are disposed adjacent the back face of the harness such that the pivotal interconnections are generally behind the torso of a user wearing the harness. In other embodiments, the upper pivot ends of the paddles are pivotally interconnected with the harness by paddle joints that allow pivotal movement of the paddle only about a generally lateral axis.

BRIEF DESCRIPTION OF THE DRAWINGS

Other objects, features and advantages of the invention will become apparent from the following description in conjunction with the accompanying drawings, wherein.

DETAILED DESCRIPTION OF THE INVENTION

The present invention provides an apparatus for floatation and propulsion of a user on a body of water. The floatation and propulsion portions of the invention may be used together or separately. In some embodiments, a user stands or kneels on the flotation device and a harness is attached to the torso of the user. A pair of paddles is pivotally interconnected with the harness such that the user may pivot the paddles and move the lower ends of the paddles in generally fore-aft paddling motion. By pivotally interconnecting the paddles to a body-mounted harness, the apparatus gives the user increased leverage on the paddles. The paddles and harness may take a variety of forms. In some embodiments, the floatation device takes the form of a board and the user stands or kneels with both feet on the board. In other embodiments, the floatation device takes the form of a pair of pontoons, with each foot being positioned in one of the pontoons. The floatation device may include an alignment system that maintains the fore-aft axes of the pontoons generally aligned parallel to one another while allowing independent up-down and fore-aft movement of the pontoons.

Figure 1:
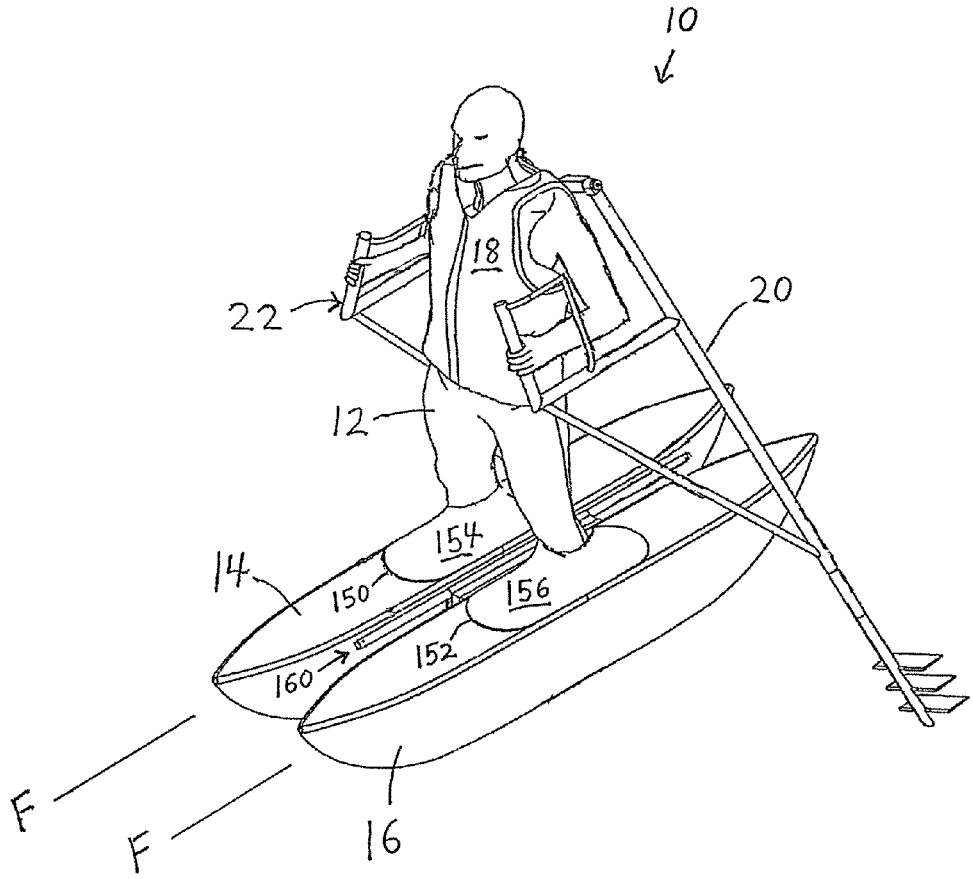
FIG. 1 is a perspective view of an apparatus for floatation and propulsion on a body of water, illustrated on a user, in accordance with an embodiment of the present invention.

Referring to FIG. 1, a first embodiment of an apparatus for floatation and propulsion of a user on a body of water is generally shown at 10, worn by a user 12. The apparatus 10 includes a floatation device, which in this embodiment takes the form of a pair of pontoons 14 and 16. As shown, one of the user's feet is received in each of the pontoons 14 and 16. The pontoons are sized and configured so as to support the user 12 on a body of water in an upright or standing position, such as shown. The apparatus 10 also includes a propulsion assembly for propelling the user 12 on the body of water. In this embodiment, the propulsion assembly takes the form of a torso-mounted harness 18 and a pair of paddles 20 and 22 that are pivotally interconnected with the harness 18.

The floatation portion and propulsion portion of the present invention may be used independently if desired. For example, the harness 18 and paddles 20 and 22 may be used with a different floatation device. Likewise, the floatation device, pontoons 14 and 16, may be used by themselves or with other propulsion assemblies. This is also true for other embodiments of floatation devices and propulsion assemblies disclosed herein.

Figure 2:
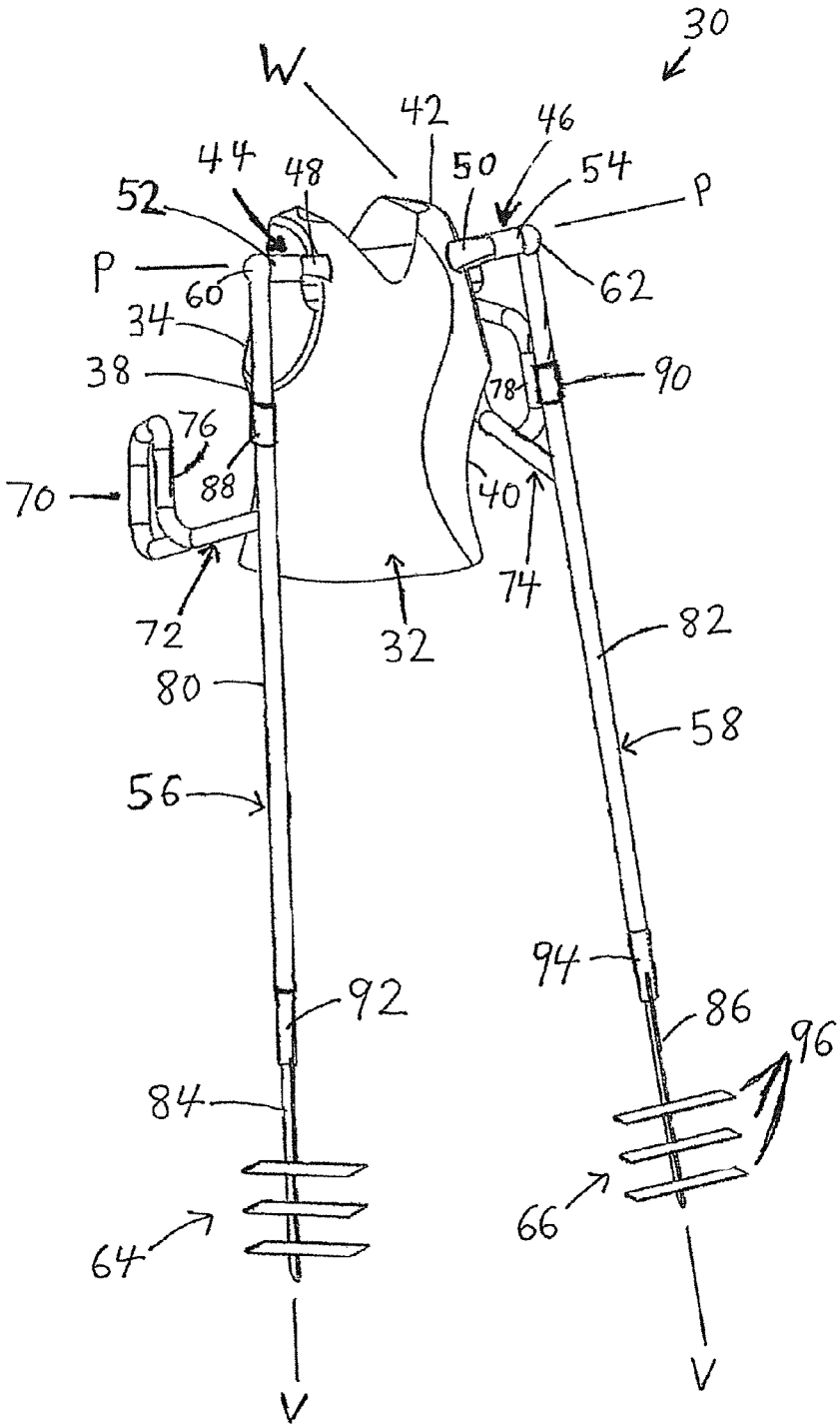
FIG. 2 is a rear perspective view of another embodiment of an apparatus in accordance with the present invention.

Referring now to FIG. 2, another embodiment of an apparatus for propulsion is generally shown at 30. This embodiment is similar to the embodiment of FIG. 1, but with some changes to the paddles. The apparatus 30 includes a harness 32 that takes the form of a jacket, which receives and wraps around the torso of a user. In other embodiments, the harness may take other forms, such as mounting just to the user's back without wrapping around the torso. For purposes of this disclosure, these other approaches are also considered to receive the torso of the user.

The harness 32 may be said to have a front face 34 and a rear face 36 each extending between a first side 38 and an opposed second side 40. When the harness is received on the torso of a user, an upper portion 42 of the harness 32 may be said to be adjacent the shoulders of the user. As used herein, "adjacent" means that an element is next to or near to something. For example, the upper portion 42 of the harness may be separated from the user's shoulder by padding or other elements and still be considered adjacent thereto. In the illustrated embodiment, the harness is part of a life jacket or personal floatation device (PFD) that wraps around the torso.

The harness 32 further includes a pair of wing elements 44 and 46 for interconnecting the paddles with the harness. The wing elements each have an inner end, 48 and 50 respectively, interconnected with the upper portion 42 of the harness and an outer end, 52 and 54 respectively.

In this embodiment, the paddles 56 and 58 are generally straight and extend between an upper pivot end, 60 and 62 respectively, and a lower water engaging end, 64 and 66 respectively. The upper pivot ends 60 and 62 are interconnected with the outer ends 52 and 54 of the wing elements by paddle joints. The paddle joints, in this embodiment, are indicated at 52 and 54, since the paddle joint is formed where the upper ends 60 and 62 of the paddles engage the outer ends 52 and 54 of the wing elements. As such, elements 52 and 54 indicate both the outer ends of the wing elements and the paddle joints. Preferably, these paddle joints each define a paddle joint axis P that is generally lateral with respect to the harness 32 and the paddle joints allow pivotal rotation only about the axes P. It should be noted that the axes P may not be the same axis for each pivot joint, since the wing elements 44 and 46 may not extend straight out along the same axis. In the illustrated embodiment, the wing elements 44 and 46 angle slightly upwardly.

In the illustrated embodiment, the harness 32 includes a generally rigid reinforcement embedded in the harness to provide structure to the harness and a location for solidly mounting the wing elements. This reinforcement may take a variety of forms. In one version, the reinforcement is referred to as an endoskeleton and has an open structure of generally rigid members. In one embodiment, the endoskeleton has an H-shape with two vertical bars connected at their midsections by one horizontal bar. This reinforcement is not visible in FIG. 2, since it is embedded in the harness. The reinforcement may be in the portion of the jacket that is adjacent the user's back. The inner ends 48 and 50 of the wing elements 44 and 46 are interconnected with the harness, such as by being interconnected with the reinforcement in the harness. The inner ends 48 and 50 may be interconnected with the reinforcement by wing joints that allow pivotal movement of the wing elements 44 and 46 about generally fore-aft axes. One generally fore-aft axis is shown at W. The axis W may be generally perpendicular to the axis P. Elements 48 and 50 may refer both to the inner ends of the wing elements and to the wing joints, since the wing joints may be defined where the inner ends connect to the reinforcement. These wing joints allow a user to pivot the paddles 56 and 58 outwardly away from their body by pushing outwardly on the paddles. This may be useful for maneuvering and to clear obstacles. The paddle joints 52 and 54 allow the paddles 56 and 58 to pivot about the pivot axes P such that the lower later engaging ends 64 and 66 move in a generally fore-aft paddling motion.

The paddles 56 and 58 include hand grips, one of which is shown at 70, so that a user may impart paddling motion to the paddles. In this embodiment, the paddles include grip extensions 72 and 74 that extend forward from a mid-portion of each paddle. The grip extensions 72 and 74 define the hand grips and also define arm support portions 76 and 78. The grip extensions begin behind and below the user's elbow, and extend forward beneath the user's arm until curving upward to the hand grips. The arm support bar portions 76 and 78 are slightly further away from the user in a lateral direction than the hand grips, so that the anterior side of the user's forearm may rest against the arm support bar while the hand is gripped on the hand grip. This allows the user to push outwardly on the arm support portions 76 and 78 to pivot the paddles 56 and 58 outwardly using the wing joints 48 and 50. Referring back to FIG. 1, the hand grips and grip extensions are formed differently than in the embodiment of FIG. 2. As will be clear to those of skill in the art, the paddles may be formed in a variety of ways. Preferably, the pivotal interconnection between the paddles and the harness, at the pivot joints 52 and 54 are to the rear of the user's torso, and may be said to be adjacent to the rear face 36 of the harness. They may also be said to be generally at shoulder height. In other embodiments, the pivots may be moved forwardly and/or downwardly, but the rear-of-torso position is preferred.

The paddles 56 and 58 may be said to have a mid-portion 80 and 82. This mid-portion interconnects the upper pivot ends 60 and 62 with the lower water engaging ends 64 and 66. Each mid-portion 80 and 82 may be said to have a lower portion, 84 and 86 respectively that defines a paddle axis V, which is generally vertical when the paddles are hanging from the upper pivot ends. In preferred embodiments, the paddle axis for each paddle intersects the paddle joint axis P.

In the illustrated embodiment, the paddles each further include a rotator joint 88 and 90 that allows the portion of the paddle below the rotator joint to rotate about the paddle axis V. As shown, the rotator joints are above the grip extensions 72 and 74. This allows a user to rotate the hand grips from a position in front of them to a position to the side. Any of the joints discussed herein may further include a locking mechanism to lock the joint in a particular position. For example, it may be desirable to lock the rotator joints during use of the paddles for paddling, and unlock them when not using the paddles. Also, any of the joints may include a travel or rotation limit. For example, the wing joints 48 and 50 may limit inward rotation to avoid contact between the paddles and the floatation device.

As will be clear to those of skill in the art, the best length for the paddles will depend on the position of the user and the user's height. The propulsion apparatus 30 may include various types of adjustments to accommodate different users and uses. As one example, the paddles 56 and 58 may have paddle length adjusters 92 and 94. These paddle length adjusters may be fixed by a pin before the user puts on the harness, or there may be a manual length adjuster device in the paddle shaft which allows the user to adjust the paddle length while wearing the paddle. Such a manual paddle length adjuster may be a lever or a rope on the outside edge of the paddle shaft.

Figure 7A:
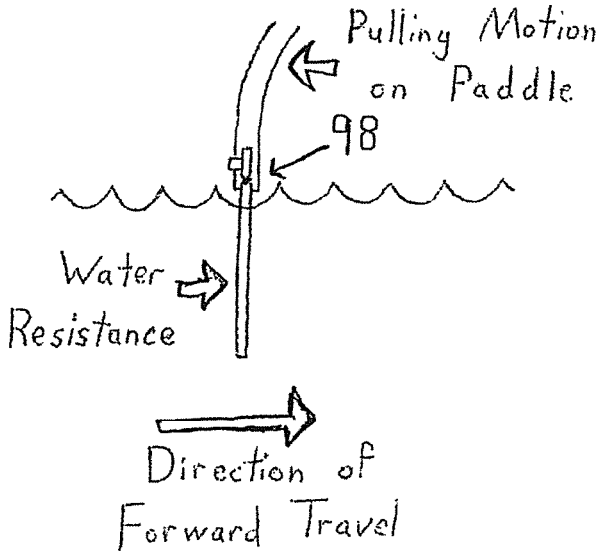
FIG. 7*a* is a close up view of a paddle blade during a power (pulling) stroke.
Figure 7B:
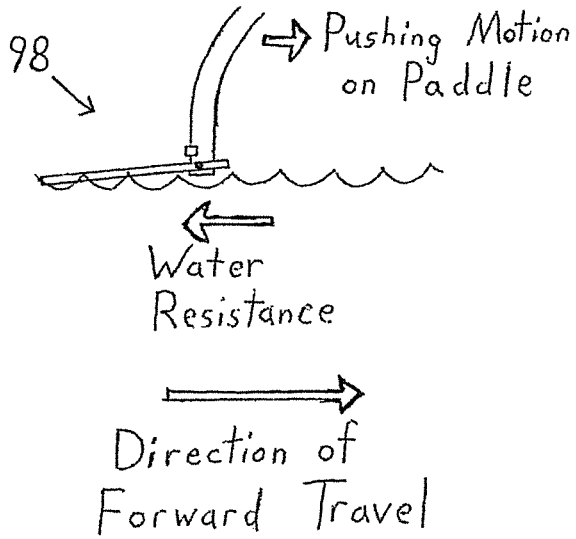
FIG. 7*b* is a close up view of a paddle blade during a recovery (pushing) stroke.
Figure 8A:
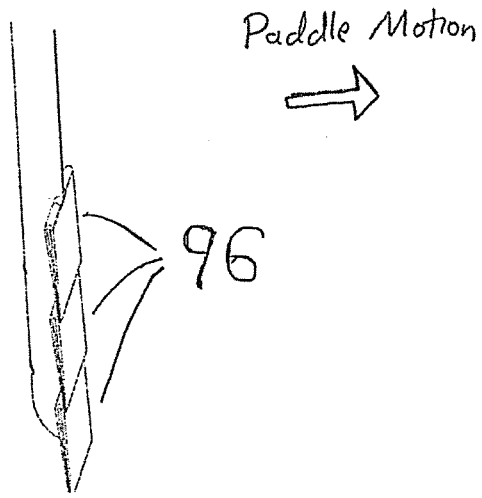
FIG. 8*a* is a close up view of a multiple blade assembly during a power stroke.
Figure 8B:
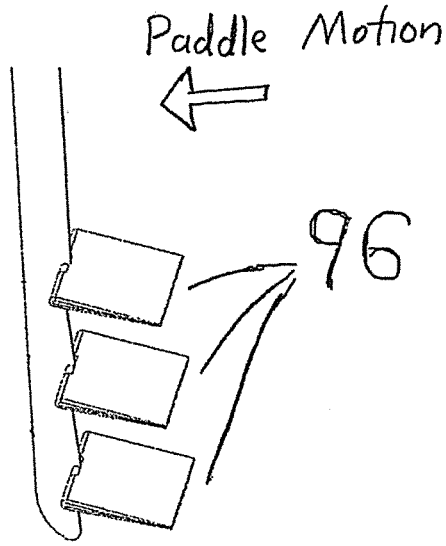
FIG. 8*b* is a close up view of a multiple blade assembly during a recovering stroke.

The lower water engaging ends of the paddles may take a variety of forms. In the illustrated embodiment, the lower ends 64 and 66 take the form of one-way water engaging elements that are movable between a water engaging position and a non-engaging position. When these elements are in the water engaging position, the elements resist movement through the water, and when the elements are in the non-engaging position, the elements pass through the water with less resistance. In the embodiment of FIG. 2, the one-way water engaging elements take the form of multiple paddle blades 96 that each pivot about a generally lateral axis. In FIG. 2, the blades 96 are shown in the non-engaging position. A single paddle blade may also be used. Referring to FIGS. 7*a* and 7*b*, a single blade one-way water engaging element is shown generally at 98. In FIG. 7*a*, the blade is in a generally vertical water engaging position. This corresponds to when the paddle is being pulled by the user for forward propulsion. FIG. 7*b* shows the blade in a generally horizontal non-engaging position, corresponding to when the user pushes the paddle forwardly for the next stroke. FIG. 8*a* shows the multiple blades 96 from FIG. 2 in a water engaging position, and FIG. 8*b* shows them in a non-engaging position. As will be clear to those of skill in the art, the one-way water engaging elements may take other forms, such as blades or elements that pivot around other axes.

Figure 3A:
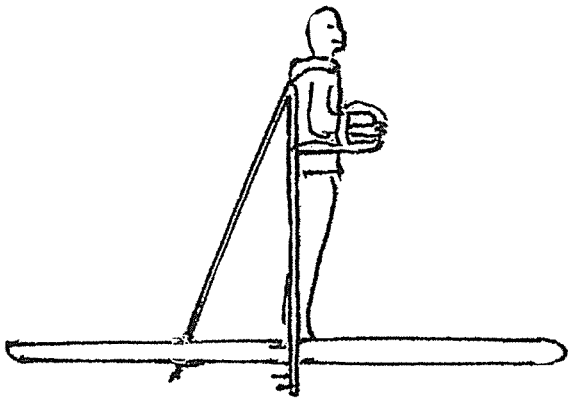
FIG. 3*a* is a side view of a user making use of an apparatus in accordance with the present invention.
Figure 3B:
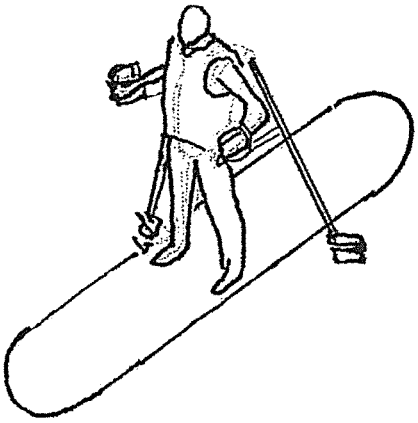
FIG. 3*b* is a perspective top view of the user and apparatus of FIG. 3*a;*
Figure 3C:
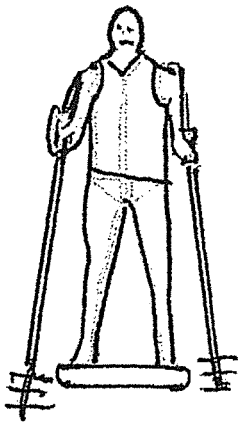
FIG. 3*c* is a front view of the user and apparatus of FIG. 3*a;*

FIGS. 3*a*, 3*b*, and 3*c* illustrates a user riding on a flat floating surface (such as a paddleboard or long surfboard) using a propulsion apparatus similar to the embodiment of FIG. 2. The user alternates pulling and pushing on the paddles, either individually or at the same time, to provide propulsion. The user may push a paddle outwardly to make a more sweeping paddle stroke to assist with maneuvering.

Figure 4:
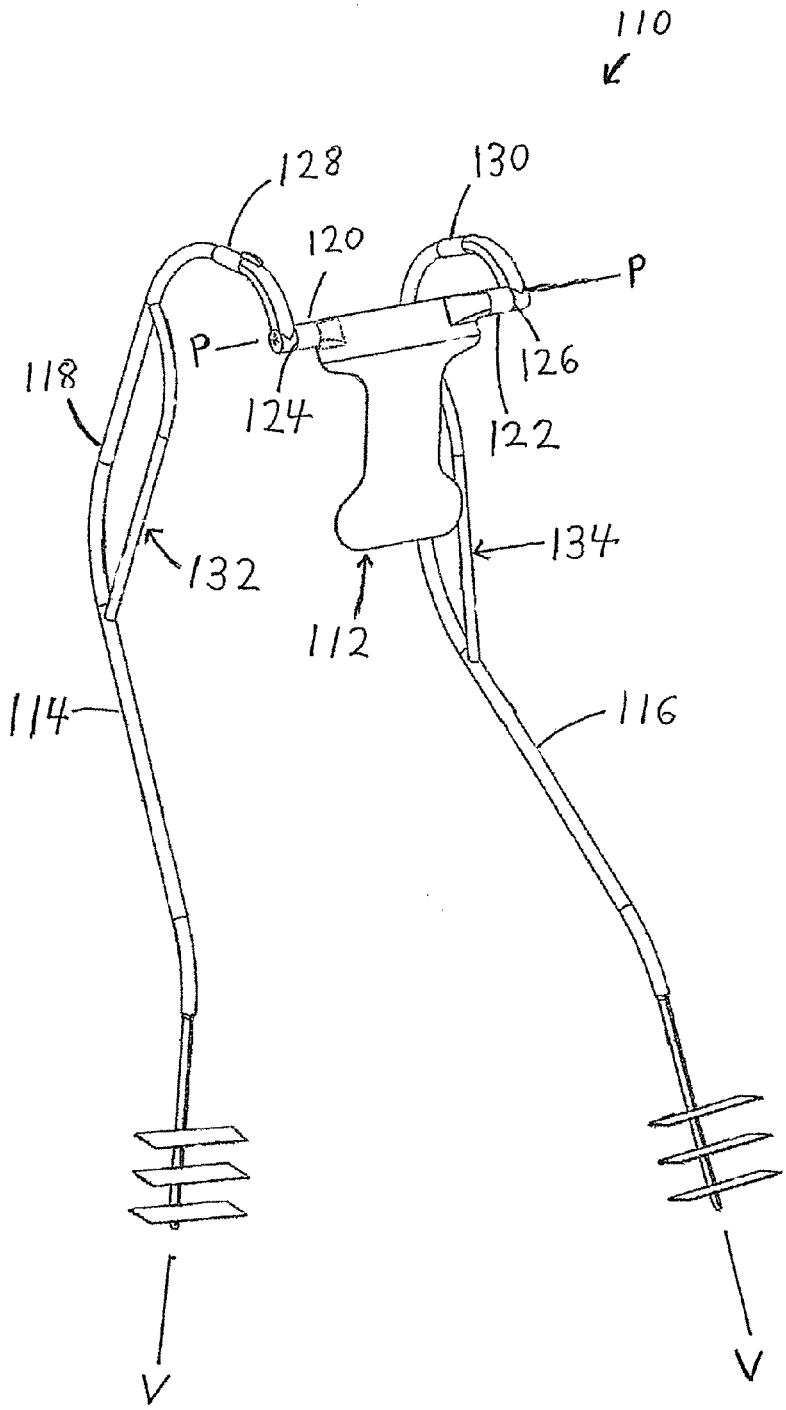
FIG. 4 is a rear perspective view of an additional embodiment of an apparatus for propulsion on a body of water, in accordance with the present invention.

FIG. 4 provides a view of an alternative embodiment of a propulsion apparatus 110 according to the present invention. A reinforcement 112 is shown without the remainder of a harness in this view. In some embodiments, the reinforcement is a generally rigid element shaped and sized to fit adjacent the user's back. In some embodiments, a padding layer, which may form part of a personal floatation device (PFD), is disposed between the reinforcement and the user's back and in others the reinforcement is not separated from the user's back by padding. In either case, the reinforcement is considered to be "adjacent" to user's back for purposes of this disclosure. As shown, in some embodiments the reinforcement has an upper portion that would be adjacent the user's shoulders and that provides an attachment area for the wing elements. Below this area is a narrower mid-portion and below the mid-portion is a lower portion that is wider than the mid-portion. The narrower mid-portion may allow freedom of motion for the user's shoulder blades. In some embodiments, the reinforcement has an overall height in the range of 15 to 25 inches and the upper portion has a width in the range of 8 to 25 inches. The reinforcement may be formed of wood, metal, plastic, a combination of these materials, or other materials. The reinforcement is preferably sufficiently rigid as to provide a solid mounting location for the wing elements, such that their relative positions are maintained. In one example, the reinforcement has a torsional rigidity in the range of 4 to 40 inch-pounds per degree. In one version, the reinforcement is a skeleton-type reinforcement with multiple members, and may also be referred to as an endoskeleton. In one sample, the endoskeleton has a horizontal top bar providing attachment points for the wing elements. Two vertical bars are connected to the top bar and are each approximately 17 inches long, 1 inch wide, and ⅛ inch thick. These vertical bars are spaced apart by 4 inches and extend down the outside of the personal floatation device (PFD), which surrounds the torso. A bottom horizontal bar is connected to the vertical bars and is approximately 8½ inches tall and 24 inches long end to end, but is curved near the ends to wrap partially around the user and stabilize the reinforcement. The center part of this bar is relatively straight for about 10 inches, and the 7 inch section at each end is curved. Other versions may also be used The embodiment of FIG. 4 differs from earlier embodiments in that the paddles 114 and 116 go over the shoulder and arm of the user to form the hand grips, such as 118, rather than having grip extensions that extend forwardly from paddle shafts behind the arm. The harness includes wing elements 120 and 122 with inner ends that are solidly connected to the reinforcement 112. The paddles pivotally interconnect to the outer ends of the wing elements at paddle joints 124 and 126. Each of these paddle joints defines a generally lateral paddle joint axis P. In order to allow outwardly movement of the paddles, the upper portion of each paddle includes a fore-aft joint 128 and 130 that allows the portion of the paddle below the joint to pivot about a generally fore-aft axis. The paddles 114 and 116 each also have arm support bars 132 and 134. When looking at either paddle from the right side, the paddle shaft is shaped like a question mark [?]. The paddle curves up and forward from the back, over the shoulder, down to the hand grip, and then backward until finally curving downward until it is straight. The lowest portion of the paddle shaft is straight and aligned so (regardless of rotation) a straight line through this lowest portion (defining axis V) will intercept the paddle joint axis P. This means that the paddle reaches its lowest point when the paddle joint is rotated so the blades are directly below it.

Figure 5:
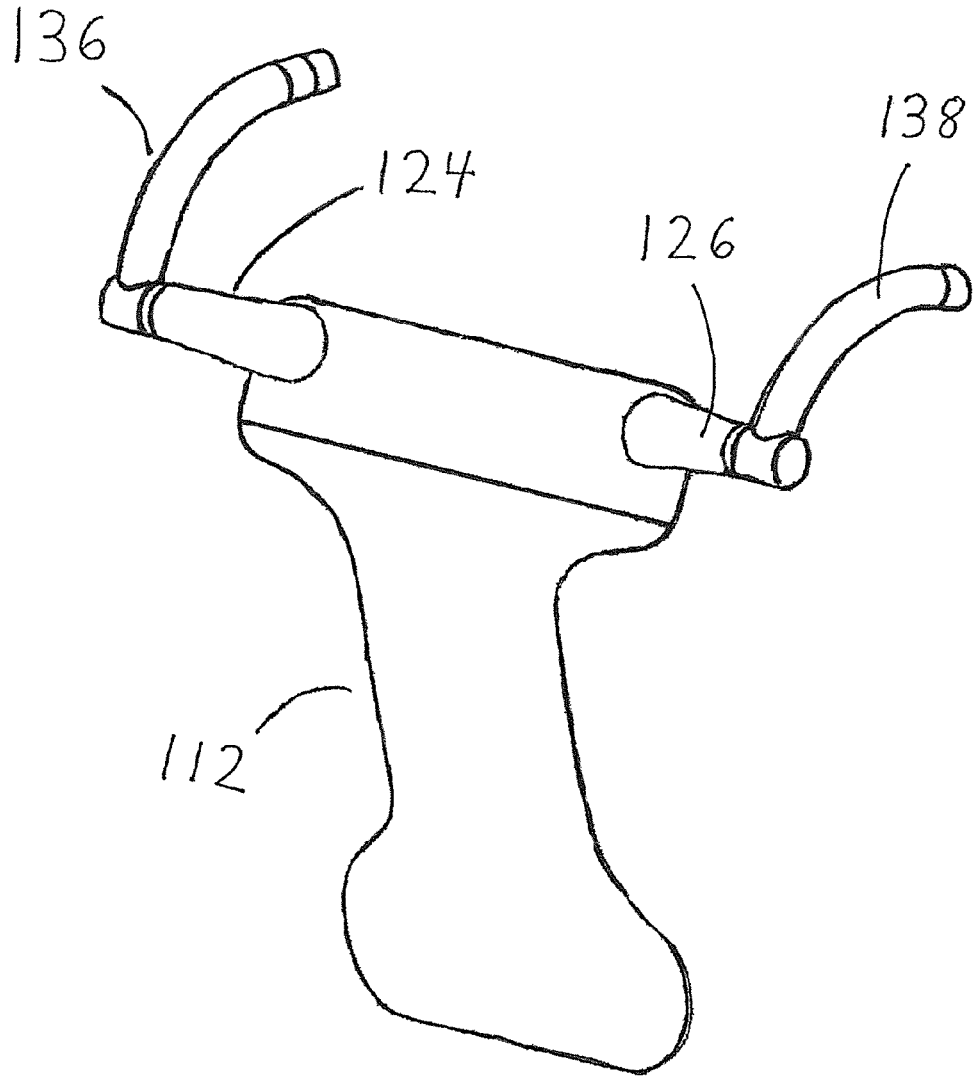
FIG. 5 is a rear perspective view of a portion of harness that forms part of some embodiments of the present invention.
Figure 6:
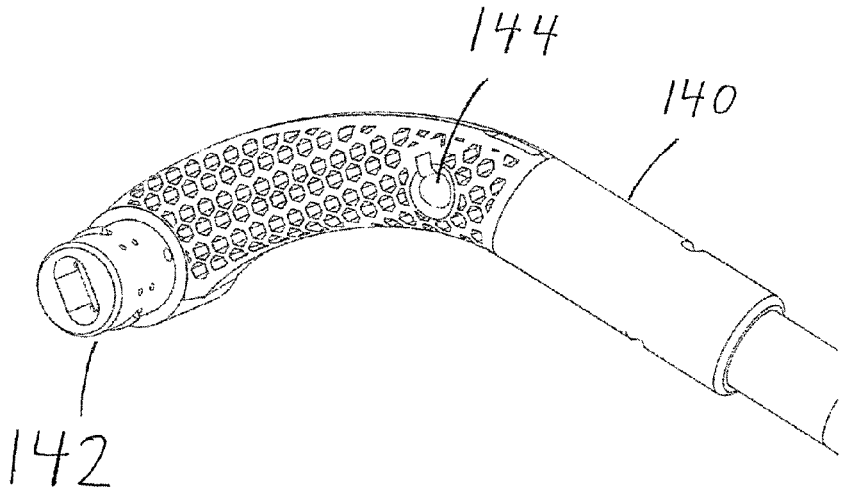
FIG. 6 is a detailed perspective view of a portion of a paddle in accordance with certain embodiments of the present invention.

FIG. 5 provides a more detailed view of the reinforcement 112 and the wing elements 124 and 126. The uppermost portion of the paddles are shown at 136 and 138. FIG. 6 shows a view of the connecting mechanism between the paddle and the wing element. The upper pivot end 140 of the paddle has a male connection 142 that may be inserted into its female counterpart on the wing element. Therefore, the paddle joint serves as both a rotational axis for the longitudinal movement of the paddle and as a connection point between the paddles and wing elements. A release button 144 is positioned on the inside of the top end of the paddle shaft, just a short distance below the connection to the wing. Pushing the release button 144 disengages the male connector 142, so the paddle and wing element separate. The paddle is easily held stable by the hand on the same side as the paddle, while the thumb of the opposite hand pushes the button and uses the fingers to hold the paddle. To reattach the paddle to the wing, the male connector just needs to be pushed into its female counterpart; this is easily done with the opposite hand holding the paddle at the top end, while the same hand holds the paddle lower on the shaft.

Referring again to FIG. 1, the pontoons 14 and 16 will be described in more detail. Each pontoon has an opening 150 and 152 in an upper surface thereof for receiving a foot of the user. The feet are placed inside of foot wells in the center of each pontoon; skirts 154 and 156 may be used to keep water out of these wells. These skirts may be attached around the user's legs using elastic straps or hook and loop tape. Each pontoon may be said to have a generally fore-aft pontoon axis, indicated at F. In FIG. 1, the pontoon axes are generally parallel to each other and aligned with the direction of forward travel.

Between and interconnecting the two pontoons is an alignment system 160 to keep the pontoons from spreading, tilting, or aiming different directions, while having independent motion forward, backward, upward and downward. The alignment system preferably maintains the fore-aft axes of the pontoons generally aligned parallel to one another while allowing independent up-down and fore-aft movement of the pontoons.

Figure 9:
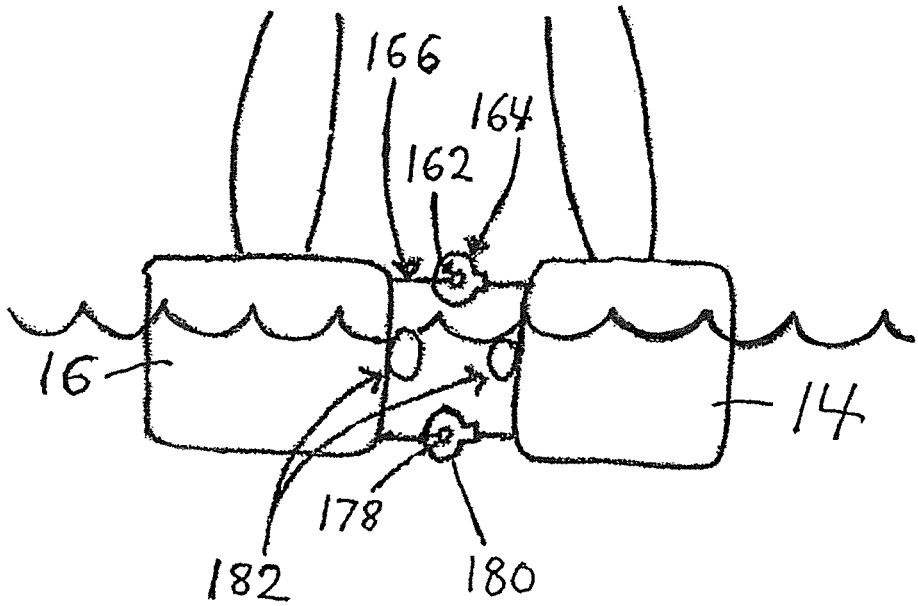
FIG. 9 is a rear perspective view of a pair of pontoons and an alignment system in accordance with an embodiment of the present invention.
Figure 10:
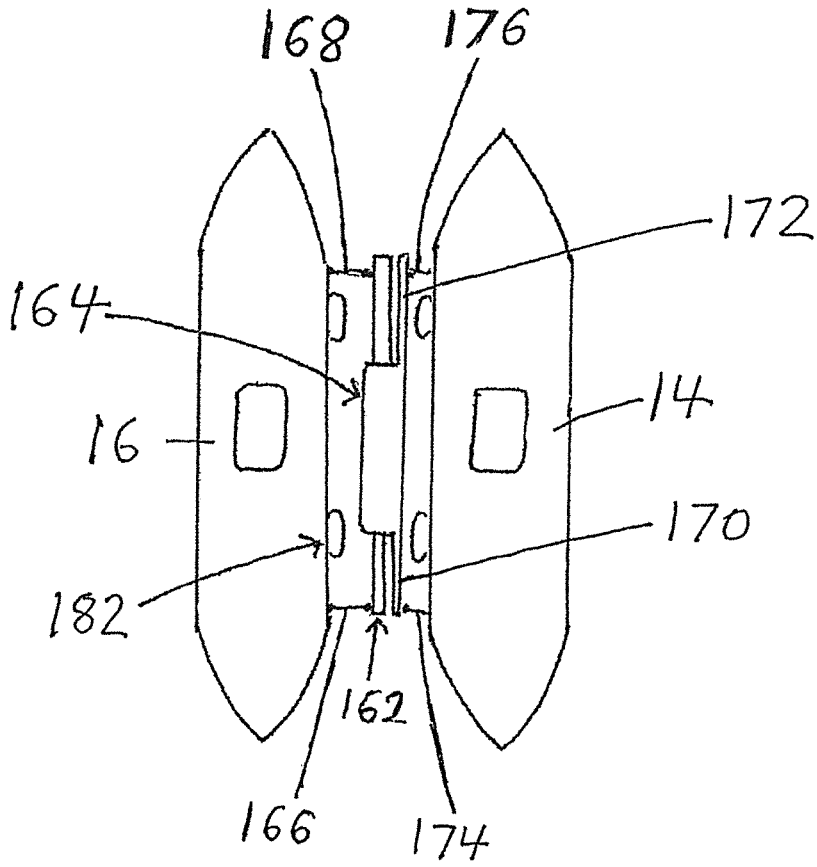
FIG. 10 is a top view of the pontoons and alignment system of FIG. 9.

FIGS. 9 and 10 show rear and top views of the pontoons 14 and 16 and alignment system 160. In this embodiment, the alignment system pairs of guide members, that take the form of concentric tubes that slidably engage one another to allow relative fore-aft movement, with one tube connected to one pontoon and the other tube connected to the other pontoon. An inner tube 162 is slidably engaged with an outer tube 164. The inner tube is longer than the outer tube and is connected to the pontoon 16 by flexible tethers 166 and 168. The tether 168 interconnects the forward end of the tube 162 with the forward end of the pontoon 16 and the tether 166 interconnects the rear end of the tube 162 with the rear end of the pontoon 16. The outer tube 164 is shorter than the inner tube 162 and has extensions 170 and 172 connected thereto. Tethers 174 and 176 interconnect the extensions with the pontoon 14.

Preferably, a second set of guide members is located below the first set. In the illustrated embodiment, this takes the form of inner tube 178 and outer tube 180, each interconnected with one of the pontoons by flexible tethers, just like the tubes 162 and 164. The tethers may elastic and provide additional movement for the pontoons. Once the system of concentric tubes is connected, the two pontoons are hindered from separating, tilting or aiming in different directions; however, they may move up and down independent of each other, as waves and forces impact them; also the pontoons are free to move independently forward and backwards. A system of bumpers 182, may also be placed between the pontoons to prevent them from hitting each other. Referring to FIG. 9, the pontoons are shown with flat bottoms, to allow a user to walk with them on a hard surface prior to entering the water. Other shapes may also be used.

Figure 11:
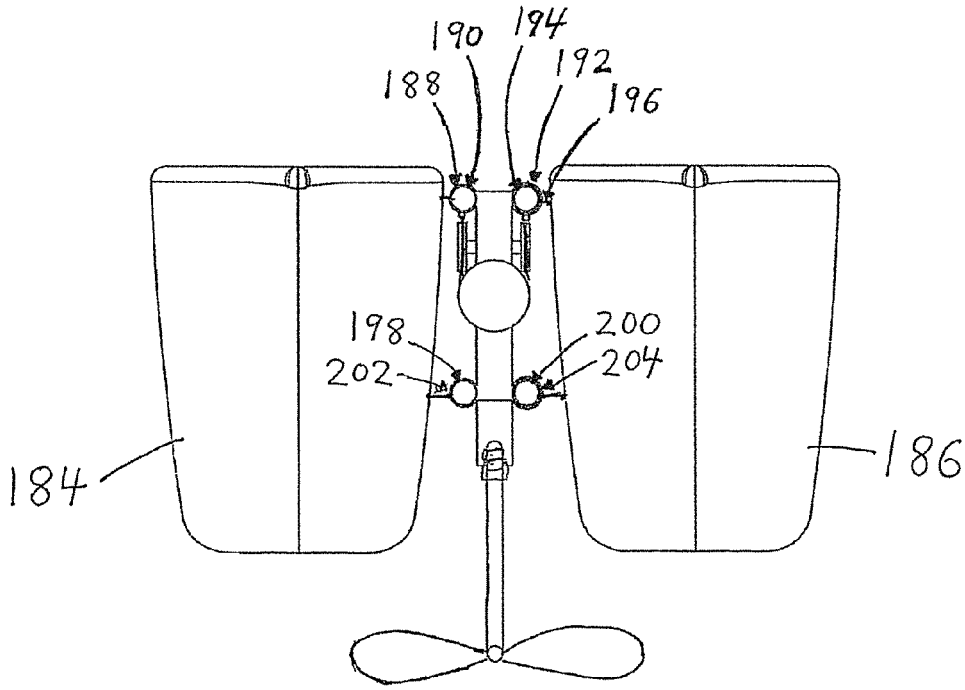
FIG. 11 is a rear perspective view of a pair of pontoons and a propulsion system in accordance with an embodiment of the present invention.

FIG. 11 shows a back view of a propulsion system provided by a mechanism held in place between the two pontoons 184 and 186. In this system, there are two sets of concentric tubes at the top: tube 188 is the outer left top tube, while 190 is inside it; on the right side, 192 is outside of 194. A propulsion system may be supported by tethers 196, so the system is held in place between the two pontoons. Two more sets of concentric tubes, 198 and 200 inside of 202 and 204, respectfully, can be tethered to the bottom of the propulsion system to hold it in place with more stability.

Figure 12:
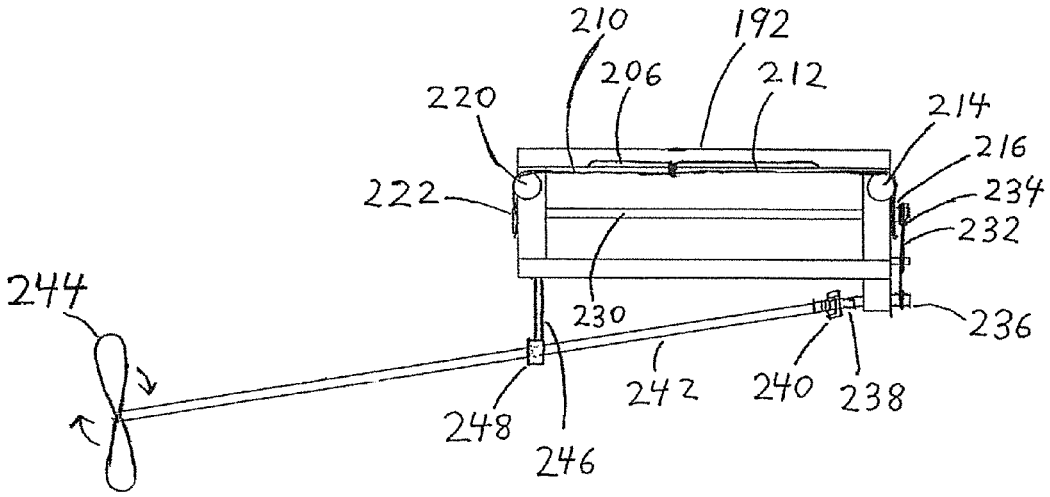
FIG. 12 is a side view of a propulsion system utilizing pontoon movement to drive a jackshaft in accordance with an embodiment of the present invention.
Figure 13:
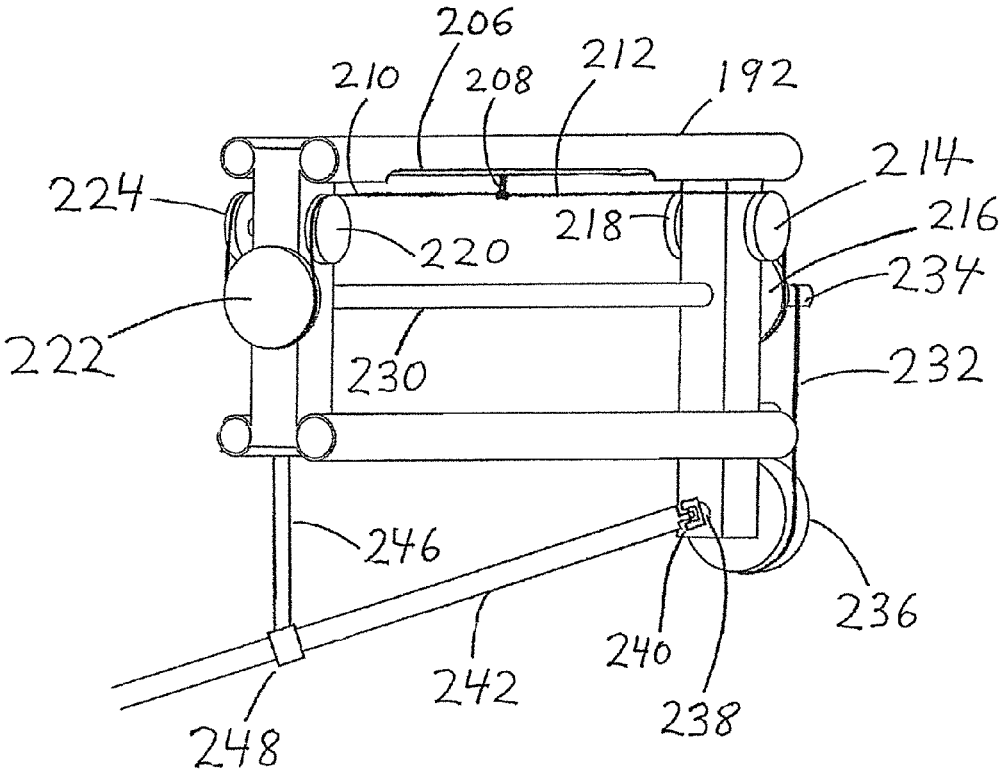
FIG. 13 is a perspective view of a portion of the propulsion system of FIG. 12.

FIG. 12 is a right side view and FIG. 13 is a front view showing the details of a propulsion system in which the lateral movements of the pontoons are used to turn a jackshaft. Both the outer tubes 188 and 192 of the top pairs of concentric tubes have long narrow slits in the bottom of them. FIGS. 12 and 13 show the slit 206 in the tube 192. Through the slit the inner tube 194 is visible. Firmly attached to 194 is a protrusion 208, to which two cables, an aft cable 210 and a fore cable 212, are attached. The fore cable 212 on the fore cable system goes from the protrusion 208 to a front-right-lateral pulley (which turns on a lateral axis) 214 to a front cable drum 216 with a one-way clutch (turning on a longitudinal axis), to a front-left-lateral pulley 218, to a protrusion connected to tube 190 through a slit through in tube 188. A complimentary aft cable 210 goes from the protrusion 208 to a rear-right-lateral pulley 220 to rear cable drum 222 to rear-left-lateral pulley 224 to the other protrusion.

When the right pontoon moves forward relative to the left pontoon, the protrusion 208 moves forward relative to the entire propulsion unit. This cause the cables to move forward on the right side, causing the front right pulley 214 to spin clockwise and the front cable drum 216 to spin counterclockwise when viewed from the front. In this direction, the one-way clutch inside of the front cable drum 216 engages, but the one-way clutch in the rear cable drum 222 disengages. Thus, the front cable drum 216 causes the jackshaft 230 to spin clockwise as viewed from the back.

When the right pontoon moves backward relative to the left pontoon, the protrusion 208 moves backward causing the cable to move backward on the right side, causing the back-right-lateral pulley 220 to spin counterclockwise and the rear cable drum 222 to spin clockwise when viewed from the back. In this direction, the one-way clutch inside of the front cable drum 216 disengages, but the one-way clutch inside of the rear cable drum 222 engages. Thus, the rear cable drum causes the jackshaft 230 to spin clockwise as viewed from the back. Therefore, whether the pontoons are moving frontward or backward, the jackshaft always spins clockwise (from an aft view). Using either a cable or a belt 232, the gear 234 on the jackshaft 230 transmits force to the propeller jackshaft gear 236 on the propeller jackshaft 238. The turning motion of the propeller jackshaft 238 is transmitted through a U-joint 240 onto the propeller shaft 242 which turns the propeller 244. The driveshaft could also be used to move another type of propulsion device (besides a propeller) such as flippers that move side-to-side or up-and-down. A strut 246, holds the propeller in one position through a strut bearing 248. The strut can be raised upward to bring the propeller above the plane of the bottom of the pontoons, so the propeller does not hit the ground while the pontoons are out of the water.

Figure 14:
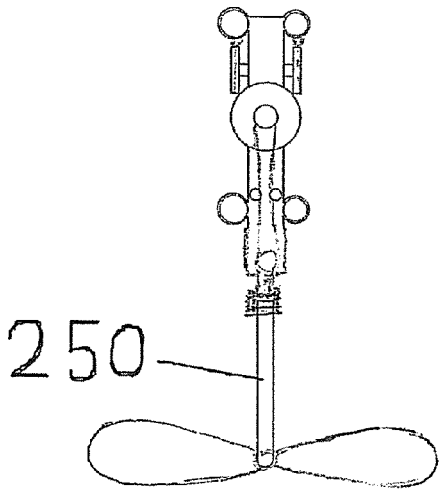
FIG. 14 is a front view of the propulsion system of FIG. 12.
Figure 15:
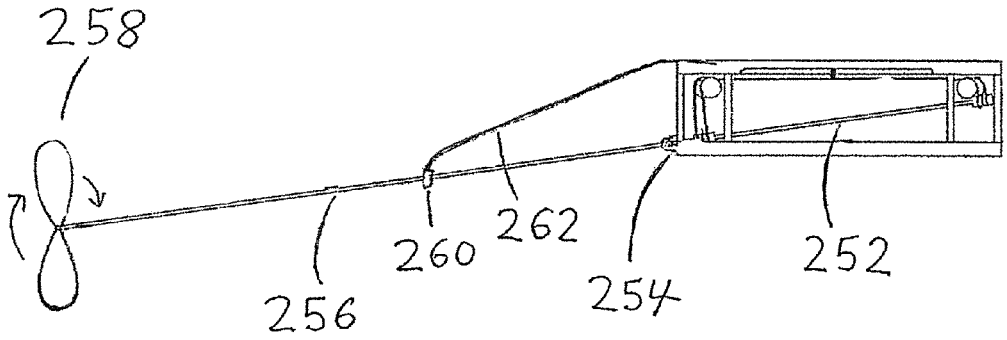
FIG. 15 is a side view of an alternative propulsion system, including a flexible propeller shaft.

FIGS. 14 and 15 show a propulsion system that directly drives a driveshaft 250, rather than having a jackshaft. Otherwise, the cable configuration is the same as in FIGS. 12 and 13. The one-way clutches cause the driveshaft 250 to spin clockwise whenever the pontoons more relative to each other in either direction.

FIG. 15 illustrates the driveshaft propulsion system using a flexible propeller shaft. Driveshaft 252 goes into propeller coupler 254 which connects to flexible propeller shaft 256, which drives the propeller 258. The propeller shaft may be made from spring steel or aluminum with a diameter of about ¼ inch. Because the propeller shaft is flexible, when the propeller spins, the propeller shaft bends in such a fashion that the end of the propeller shaft nearest to the propeller becomes more horizontal. A hinge may be positioned at the propeller coupler to allow the propeller shaft to be raised. A propeller raising bearing 260 is positioned along the propeller shaft. Connected to this propeller raising bearing is a raising bearing cable 262 which may be pulled to lift the propeller shaft. The raising bearing cable may be attached to the unit frame between the pontoons, or to the pontoons themselves.

Figure 16:
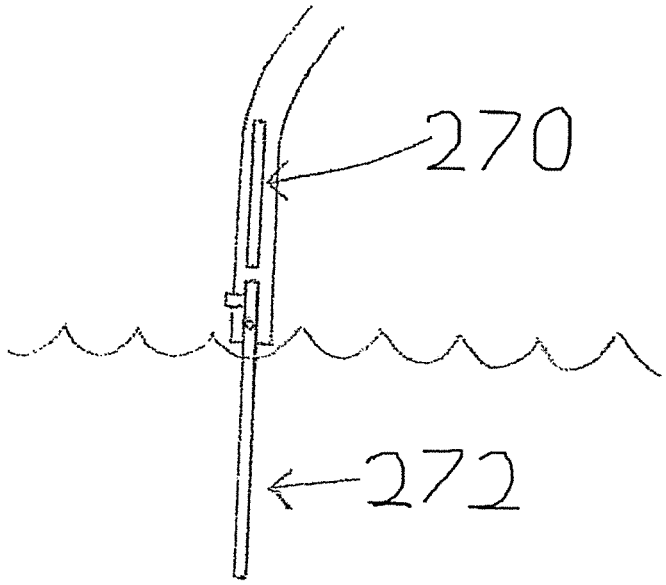
FIG. 16 is a side view of a lower portion of a paddle with a stabilizing blade that may be provided in some embodiments of the present invention.

FIG. 16 illustrates a stabilizing paddle 270 above a paddle blade 272. The stabilizing paddle is a rigid, fixed paddle which functions like a regular kayak paddle (i.e. it is not one-directional). It may be used for balance and stability under rough waves or surf. In normal paddling with the one-directional paddles, the stabilizing paddle stays above the water.

Figure 17:
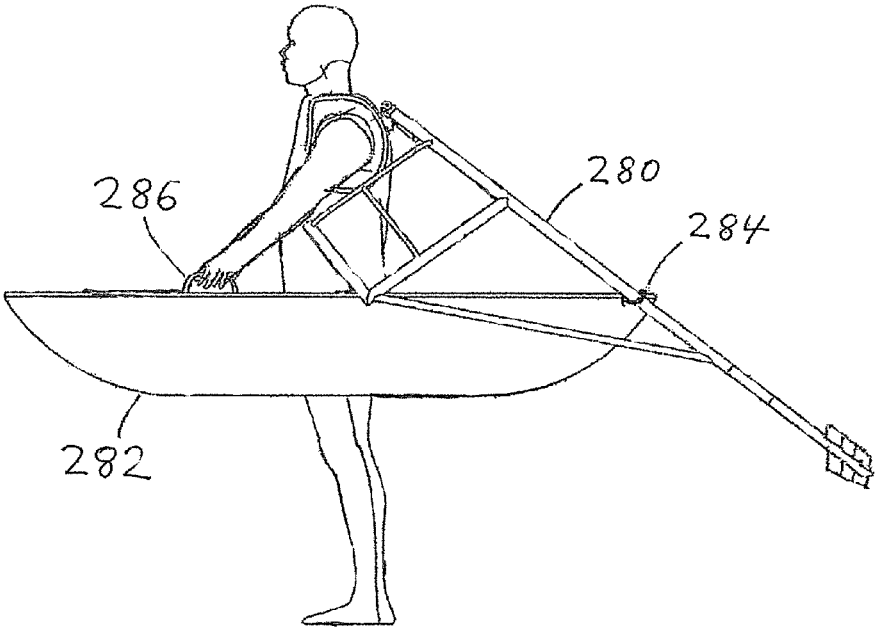
FIG. 17 is a side view of an embodiment of the present invention with over-land carrying handles and connections.

FIG. 17 illustrates an over-land carrying system including attachments between the pontoons and the paddles and handholds for the user. The paddles 280 are connected to the pontoons 282 by a fastener 284. This fastener may be any simple device, such as a hook, snap, rope, loop tape, or carabiner, which holds the paddle to the pontoon. This fastener may be fore or aft of the user depending on the implementation of the paddle shape. The person's hands pick up the pontoons using handles 286. To carry the pontoons over land, the pontoons are set on the ground next to each other, with the tethers to the concentric tubes disconnected on one side. To keep the propulsion unit on the outside while carrying, the pontoons can be set on the ground with the right pontoon on the left side. The user puts the harness without the paddles attached. Then the user fastens the paddles 280 to the pontoons 282 using the fastener 284. Then the user gets low to the ground between the pontoons and attaches the paddles to the harness. Finally, the user grabs the handles 286 and stands up. After walking to the desired location, the user sets down the pontoons, lets go of the handles, disconnects the paddles from the harness, and then disconnects the paddles from the pontoons.

Figure 18:
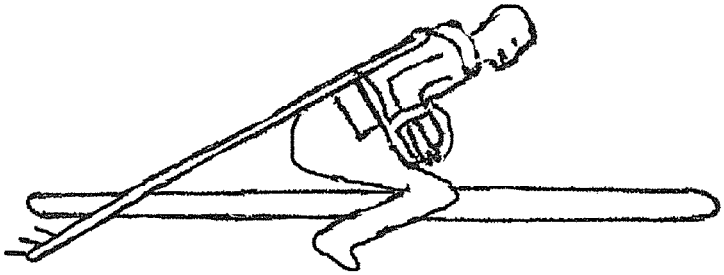
FIG. 18 is a perspective view of an alternative embodiment of the present invention configured for use by a user in a kneeling position.

FIG. 18 illustrates an alternative embodiment of the present invention with paddles to be used while kneeling.

As will be clear to those of skill in the art, the herein described embodiments of the present invention may be altered in various ways without departing from the scope or teaching of the present invention. It is the following claims, including all equivalents, which define the scope of the invention.

The invention claimed is:

1. An apparatus for floatation and propulsion of a user on a body of water with the user in a standing or kneeling position, the apparatus comprising:

a floatation device for supporting a user in a standing or kneeling position on a body of water;

a harness having a front face and a back face each extending between a first side and a second side, the harness configured to receive a torso of the user such that an upper portion of the harness is adjacent the shoulders of the user;

a first paddle having an upper pivot end and a lower water engaging end with a mid-portion extending therebetween; the upper pivot end of the first paddle being pivotally interconnected with the harness on the first side of the harness such that the lower water engaging end may be moved in a paddling motion in a generally fore-aft direction relative to the harness;

a second paddle having an upper pivot end and a lower water engaging end with a mid-portion extending therebetween; the upper pivot end of the second paddle being pivotally interconnected with the harness on the second side of the harness such that the lower water engaging end may be moved in a paddling motion in a generally fore-aft direction relative to the harness;

the pivotal interconnections between the upper pivot ends of the paddles and the harness being disposed adjacent the back face of the harness such that the pivotal interconnections are generally behind the torso of a user wearing the harness; and whereby the harness and paddles cooperate to provide propulsion on a body of water.

2. An apparatus in accordance with claim 1, wherein:

the harness comprises an reinforcement and a pair of wing elements each having an inner end and an outer end, the inner ends of the wing elements each being interconnected with the upper portion of the harness; and the upper pivot ends of the paddles each being pivotally connected to the outer end of one of the wing elements by a paddle joint, each paddle joint allowing pivotal movement of the paddle only about a generally lateral axis.

3. An apparatus in accordance with claim 2, wherein:

each wing element is interconnected with the reinforcement by a wing joint, the wing joint allowing pivotal movement of the wing element about a generally fore-aft axis such that one of the paddles connected to the outer end of the wing joint may be swung outwardly away from the user.

4. An apparatus in accordance with claim 1, wherein:

each paddle further includes a fore-aft joint allowing a portion of the paddle to pivot outwardly about a generally fore-aft axis.

5. An apparatus in accordance with claim 1, wherein:

each paddle has a hand grip positioned so as to be gripped by a hand of the user to impart the paddling motion and an arm support portion positioned so as to be outboard of a forearm of the user, the arm support portion allowing the user to push the paddle outwardly away from the harness.

6. An apparatus in accordance with claim 5, wherein:

each paddle has a grip extension interconnected with the mid-portion, the grip extension defining the hand grip and arm support portion of each paddle.

7. An apparatus in accordance with claim 5, wherein:

the mid-portion of each paddle extends forwardly and then downwardly from the upper pivot end such that the hand grip is defined by the mid-portion, the mid-portion extending rearwardly and downwardly from the hand grip to the lower end.

8. An apparatus in accordance with claim 1, wherein:

the upper pivot end of each paddle is pivotally interconnected with the harness by a paddle joint, the paddle joint defining a generally lateral paddle joint axis; and the mid-portion of each paddle has a lower portion that extends along and defines a paddle axis, the paddle axis intersecting the paddle joint axis.

9. An apparatus in accordance with claim 1, wherein:

each paddle further comprises a rotator joint that allows a portion of the paddle to rotate about a paddle axis relative to the harness such that a hand grip portion of the paddle may be rotated from a position generally in front of the user to a position to the side of the user.

10. An apparatus in accordance with claim 1, wherein:

the lower water engaging end of each paddle comprises a paddle shaft and a one-way water engaging element that is movable between a water engaging position and a non-engaging position such that when the element is in the water engaging position the element resists movement through the water and when the element is in the non-engaging position the element passes through the water with reduced resistance.

11. An apparatus in accordance with claim 10, wherein:

the one-way water engaging element comprises at least one paddle blade pivotally interconnected with the paddle shaft for pivotal movement between the water engaging position and the non-engaging position.

12. An apparatus in accordance with claim 10, wherein:

each paddle further comprises a stationary blade disposed above the one-way water engaging element.

13. An apparatus in accordance with claim 1, wherein:

the floatation device comprises a pair of pontoons, each pontoon configured to receive one foot of the user for supporting the user on the body of water, each pontoon having a generally fore-aft axis.

14. An apparatus in accordance with claim 13, wherein:

the pair of pontoons is interconnected by an alignment system operable to maintain the fore-aft axes of the pontoons generally aligned parallel to one another while allowing independent up-down and fore-aft movement of the pontoons.

15. An apparatus in accordance with claim 14, wherein:

the alignment system comprises:

a first guide member and a pair of flexible tethers interconnecting the first guide member with one pontoon; and a second guide member and a pair of flexible tethers interconnecting the second guide member with the other pontoon; and the guide members being slidably engaged with each other for relative movement along an axis generally parallel to the fore-aft axes of each pontoon.

16. An apparatus in accordance with claim 13, further comprising:

a frame interconnected with the pontoons; and a propulsion system supported by the frame, the propulsion system driven by movement of one of the pontoons relative to the other of the pontoons.

17. An apparatus in accordance with claim 16, wherein the propulsion system includes a cable interconnected with each of the pontoons such that relative movement of one of the pontoons relative to the other of the pontoons moves the cable.

18. An apparatus in accordance with claim 17, wherein the propulsion system further includes a propeller and a flexible propeller shaft.

19. An apparatus in accordance with claim 13, wherein each of the pontoons has a flat bottom so as to allow a user to walk on a hard surface.

20. An apparatus in accordance with claim 1, wherein:

there is no interconnection between the floatation device and harness or paddles.

21. An apparatus for floatation and propulsion of a user on a body of water, the apparatus comprising:

a floatation device for supporting a user on a body of water;

a harness having a front face and a back face each extending between a first side and a second side, the harness configured to receive a torso of the user such that an upper portion of the harness is adjacent the shoulders of the user;

a first paddle having an upper pivot end and a lower water engaging end with a mid-portion extending therebetween; the upper pivot end of the first paddle being pivotally interconnected with the harness on the first side of the harness such that the lower water engaging end may be moved in a paddling motion in a generally fore-aft direction relative to the harness;

a second paddle having an upper pivot end and a lower water engaging end with a mid-portion extending therebetween;

the upper pivot end of the second paddle being pivotally interconnected with the harness on the second side of the harness such that the lower water engaging end may be moved in a paddling motion in a generally fore-aft direction relative to the harness; and the upper pivot ends of the paddles each being pivotally connected to the harness by a paddle joint, each paddle joint allowing pivotal movement of the paddle only about a generally lateral axis.

22. An apparatus for floatation and propulsion of a user on a body of water, the apparatus comprising:

a floatation device for supporting a user on a body of water;

a harness having a front face and a back face each extending between a first side and a second side, the harness configured to receive a torso of the user such that an upper portion of the harness is adjacent the shoulders of the user, the harness comprising a personal floatation device (PFD) that wraps around the user's torso and a reinforcement disposed in the personal floatation device such that the reinforcement is adjacent the user's torso when the user's torso is received in the harness;

a first paddle having an upper pivot end and a lower water engaging end with a mid-portion extending therebetween; the upper pivot end of the first paddle being interconnected with reinforcement of the harness on the first side of the harness such that the lower water engaging end may be moved in a paddling motion in a generally fore-aft direction relative to the harness;

a second paddle having an upper pivot end and a lower water engaging end with a mid-portion extending therebetween; the upper pivot end of the second paddle being interconnected with the reinforcement of the harness on the second side of the harness such that the lower water engaging end may be moved in a paddling motion in a generally fore-aft direction relative to the harness; and whereby the harness and paddles cooperate to provide propulsion on a body of water.

* * * * *